US007796725B1

(12) United States Patent
Wu et al.

(10) Patent No.: US 7,796,725 B1
(45) Date of Patent: Sep. 14, 2010

(54) MECHANISM FOR SWITCHING SOURCES IN X-RAY MICROSCOPE

(75) Inventors: Ziyu Wu, Beijing (CN); Wenbing Yun, Walnut Creek, CA (US); Peiping Zhu, Beijing (CN); Yuxin Wang, Northbrook, IL (US); Qingxi Yuan, Beijing (CN); Andrei Tkachuk, Walnut Creek, CA (US); Wanxia Huang, Beijing (CN); Michael Feser, Walnut Creek, CA (US)

(73) Assignee: Xradia, Inc., Concord, CA (US)

( * ) Notice: Subject to any disclaimer, the term of this patent is extended or adjusted under 35 U.S.C. 154(b) by 0 days.

(21) Appl. No.: 12/401,750

(22) Filed: Mar. 11, 2009

Related U.S. Application Data

(60) Provisional application No. 61/035,481, filed on Mar. 11, 2008, provisional application No. 61/035,479, filed on Mar. 11, 2008.

(51) Int. Cl.
*G21K 7/00* (2006.01)

(52) U.S. Cl. ..... 378/43

(58) Field of Classification Search ..... 378/43, 378/193, 62, 197
See application file for complete search history.

(56) References Cited

U.S. PATENT DOCUMENTS 5,216,699 A * 6/1993 Iketaki ..... 378/43

* cited by examiner

*Primary Examiner*—Courtney Thomas
(74) *Attorney, Agent, or Firm*—Houston Elisceva LLP

(57) ABSTRACT

An x-ray imaging system uses a synchrotron radiation beam to acquire x-ray images and at least one integrated x-ray source. The system has an imaging system including sample stage controlled by linear translation stages, objective x-ray lens, and x-ray sensitive detector system, placed on a fixed optical table and a mechanical translation stage system to switch x-ray sources when synchrotron radiation beam is not available.

12 Claims, 3 Drawing Sheets

MECHANISM FOR SWITCHING SOURCES IN X-RAY MICROSCOPE

RELATED APPLICATIONS

This application claims the benefit under 35 USC 119(e) of U.S. Provisional Application Nos. 61/035,481, filed on Mar. 11, 2008, and 61/035,479, filed on Mar. 11, 2008, both of which are incorporated herein by reference in their entirety.

This application relates to U.S. application Ser. No. 12/401,740 filed on Mar. 11, 2009, entitled "X-Ray Microscope with Switchable X-Ray source," by Ziyu Wu et al.

BACKGROUND OF THE INVENTION

X-ray imaging techniques have become important parts of our lives since the invention in the 19th century. The majority of these x-ray imaging systems use table-top electron-bombardment x-ray sources, but synchrotron radiation sources, which provide highly collimated beams with 6 to 9 orders of magnitude higher brightness and tunable narrow bandwidths, have greatly expanded the capabilities of x-ray imaging techniques and also enabled spectral microscopy techniques that are able to selectively image specific elements in a sample.

One significant limitation of synchrotron radiation facilities is the relatively long down-time compared with tabletop x-ray sources. While a tabletop source can run continuously between annual or semi-annual maintenance intervals, synchrotrons typically require more frequent maintenance intervals with long shutdown times. These maintenance requirements can lead to excessive down-time of the x-ray imaging instruments.

SUMMARY OF THE INVENTION

The solution described here is to integrate a tabletop x-ray source to the x-ray microscope so that it can be used to power the instrument when the synchrotron x-ray beam is not available. A mechanical system is used to switch between these two x-ray sources.

This invention pertains to the mechanical systems used to switch x-ray sources in a high-resolution x-ray imaging system. For example, an x-ray microscope stationed at a synchrotron radiation facility will normally perform the imaging operations using the high brightness synchrotron radiation, but it will switch to an alternative self-contained x-ray source such as a table-top x-ray source, when the synchrotron is not in operation, e.g., during maintenance periods.

The design described in this disclosure uses a rotating anode type x-ray source in conjunction with the synchrotron radiation source and a mechanical translation system to switch the sources.

In general according to one aspect, the invention features an x-ray imaging system that uses synchrotron radiation beams to acquire x-ray images and at least one integrated x-ray source. The system has an imaging system including a sample stage controlled by linear translation stages, an objective x-ray lens, and an x-ray sensitive detector system, placed on a fixed optical table and a mechanical translation stage system to switch x-ray sources.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings.

DETAILED DESCRIPTION OF THE PREFERRED EMBODIMENTS

Figure 1:
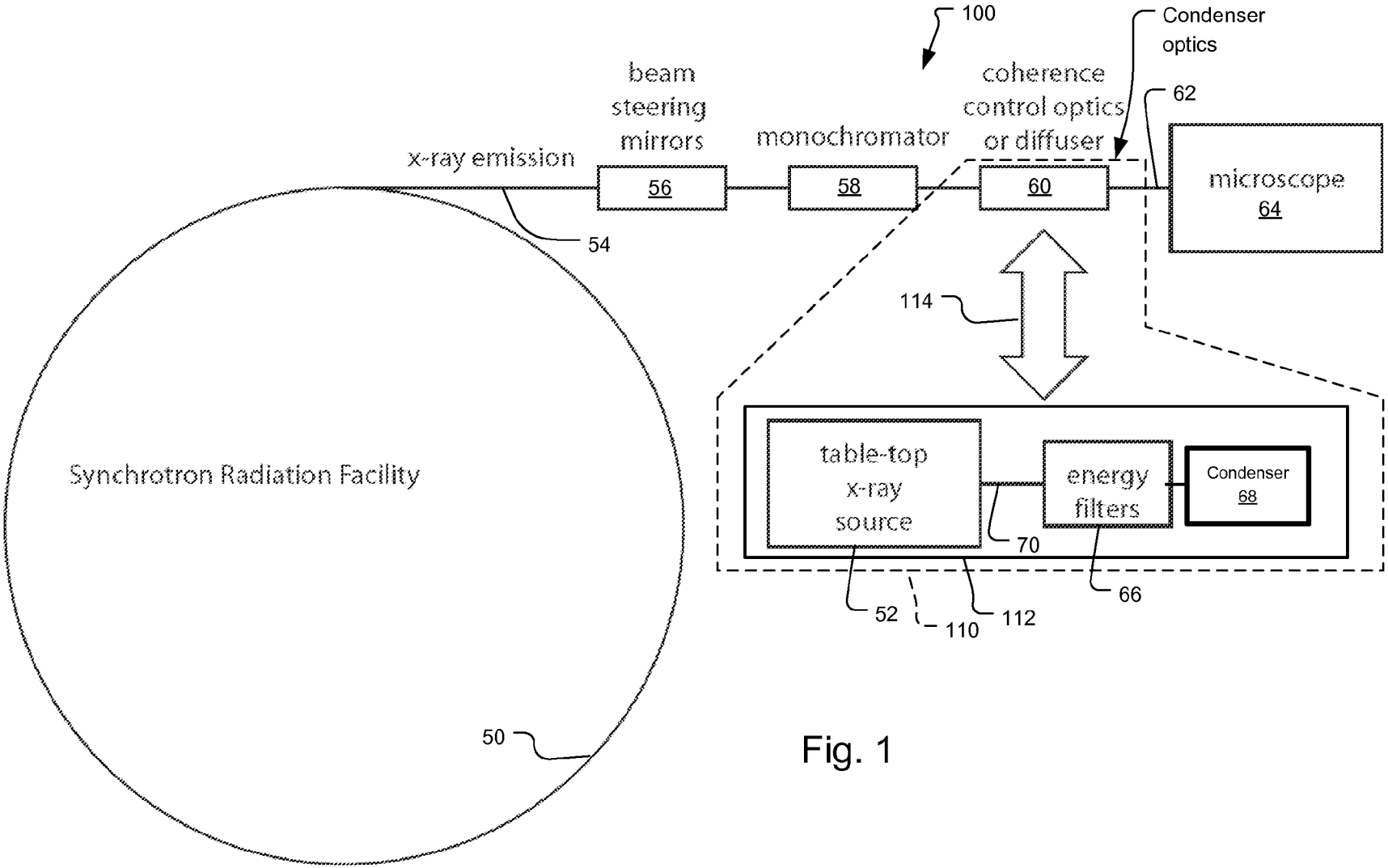
FIG. 1 is a schematic diagram of a synchrotron-based x-ray microscope that includes an integrated table-top x-ray source along with its energy filtering system with a mechanical translation system that switches between the two x-ray sources.

FIG. 1 shows x-ray microscope system 100 using a table-top source 52 and synchrotron source 50 according to the principals of the present invention.

Synchrotrons generate highly collimated x-ray radiation with tunable energy. They are excellent sources for high-resolution x-ray microscopes. The x-ray radiation 54 generated from the synchrotron 50 is controlled and aligned by the beam-steering mirrors 56. It then reaches a monochromator 58 to select a narrow wavelength band. The monochromator 58 is typically gratings or a crystal monochromator to disperse the x-ray beam 54 based on wavelength. When combined with entrance and exit slits, it will select a specific energy from the dispersed beam. The energy resolution will depend on the grating period, distance between the slits and grating, and the slit sizes.

Also included is the table-top x-ray source 52. Typically this source is a rotating anode, microfocus, or x-ray tube source.

Either of the table-top x-ray source 52 and the synchrotron 50 provides a radiation beam 62 to an x-ray imaging system 64. For high resolution applications, the imaging system 64 is a microscope, which includes sample holder or stage controlled by linear translation stages, for holding the sample, an objective lens for forming an image of the sample and a detector system for detecting the image formed by the objective lens. In one example, a zone plate lens is used as the objective lens. A compound refractive lens is used on other examples. In the preferred implementation, the imaging system 64 is full-field imaging x-ray microscope, but in other examples a scanning x-ray microscope is used.

Preferably, a rotation stage is included on the linear translation stages of the imaging system to rotate a sample within the range of 360 degrees.

The monochromator 58 is usually used to produce a monochromatic beam in order to satisfy energy bandwidth requirements of the imaging system 64. For example, commonly used objective lenses in x-ray microscopy are Fresnel zone plate lenses. They provide very high resolution of up to 50 nanometers (nm) with higher energy x-rays above 1 keV and 25 nm for lower energy x-rays. Since these lenses are highly chromatic, using a wider spectrum will lead to chromatic aberration in the image. Zone plates typically require a monochromaticity on the order of number of zones in the zone plate lens. This is typically 200 to several thousand, thus leading to a bandwidth of 0.5% to 0.05%. This energy selection process of the monochromator 58 typically makes use of a small portion of the x-ray radiation generated by the source and rejects the rest of the spectrum from the synchrotron 50.

In contrast, emissions from a table-top x-ray sources typically contain a sharp characteristic emission line superimposed on a broad Bremsstrahlung background radiation. The characteristic emission line typically contains a large portion the total emission, typically 50-80%, within a bandwidth of 1/100 to 1/500. In order to create a monochromatic radiation, an absorptive energy filter system 66 is used to remove unwanted radiation from the table-top x-ray source 52 and only allow a particular passband. Two filters are often used: one to absorb primarily low energy radiation below the characteristic line and one to absorb energies above the emission line. This filtering system provides a very simple way to condition the beam but at a cost of some absorption loss of radiation.

Alternatively, a monochromator system can also be used in the filter system 66. This typically contains a grating or multilayer to disperse the x-ray radiation and an exit slit to block unwanted radiation.

The source switching system requires monochromatization devices for both synchrotron radiation source 50 and table-top x-ray source 52. In most applications, the synchrotron beam monochromator 58 is built into the beamline and the monochromator/filters 66 for the table-top source 52 are integrated into the x-ray source 52 or the switching system 110.

Synchrotron radiation typically has much higher spatial coherence, i.e. too highly collimated, than is suitable for a full-field imaging microscope and must be reconditioned using beam conditioning optics 60 that modify the x-ray characteristics to meet the requirements of the x-ray imaging system 64. Typical methods to reduce the coherence use a diffusing element such as polymers arranged in random directions or a rotating element. This approach is very simple to implement but has the disadvantage of losing significant amount of radiation intensity.

Alternatively, the conditioning optics 60 use a set of two mirrors that first deflect the beam off axis and then reflect the deflected beam toward to focal point on axis. This set of mirrors is allowed to rotate rapidly about the optical axis to create a cone shaped beam illumination pattern that will provide increased divergence.

In some examples, the beam conditioning optics 60 include diffractive element(s) such as a grating and Fresnel zone plate lenses or reflective elements such as ellipsoidal lenses or Wolter mirrors. Compound refractive lenses can also be used.

Another method to increase the beam divergence is to use a capillary lens as the conditioning optics 60 to focus the beam towards the focal point. This method provides a simple means of modifying the collimation of the beam. The capillary lens can be scanned rapidly in a random pattern. Finally, a grating upstream of the capillary lens can be used to further increase the beam divergence.

The beam coherence of the beam 70 of laboratory source 52 is very different from that of synchrotron 50. Table-top sources behave like point sources so that radiation emitted is roughly omni-directional. With these types of sources a simple capillary lens is preferably used as a condenser 68 to project the source's radiation towards the sample. The capillary lens is generally designed in an ellipsoidal shape with the x-ray source and sample at the foci.

The switch system 110 contains the condenser optics 68 for the table top source 52 and the conditioning optics 60 for the synchrotron 50. Both optics are contained in the switching system and switched along with the x-ray sources. The switching system 110 includes a mechanical positioning system that is integrated to ensure reliable repositioning of each optic after each switching action. This switching system 110 is based on a combination of kinematic mounting systems, mechanical stages, electromechanical motors, optical encoders, capacitance position measurements, etc.

The system 110 switches between the synchrotron source 50 and table-top x-ray source 52 with a mechanical translation system that replaces the conditioning optics 60 with the table-top source 52, energy filters 66 and condenser 68 in beam axis to the imaging system 64. The table-top x-ray source 52 and its energy filters 66 and condenser optics 68 are integrated in a single assembly 112 and mounted on a motorized translation stage of the system 110 with optical encoders. The conditioning optics 60 for the synchrotron beam is mounted at the opposite end of the mechanical translation stage. Therefore, the switching action can be made by a simple translational action, see arrow 114.

Figure 2:
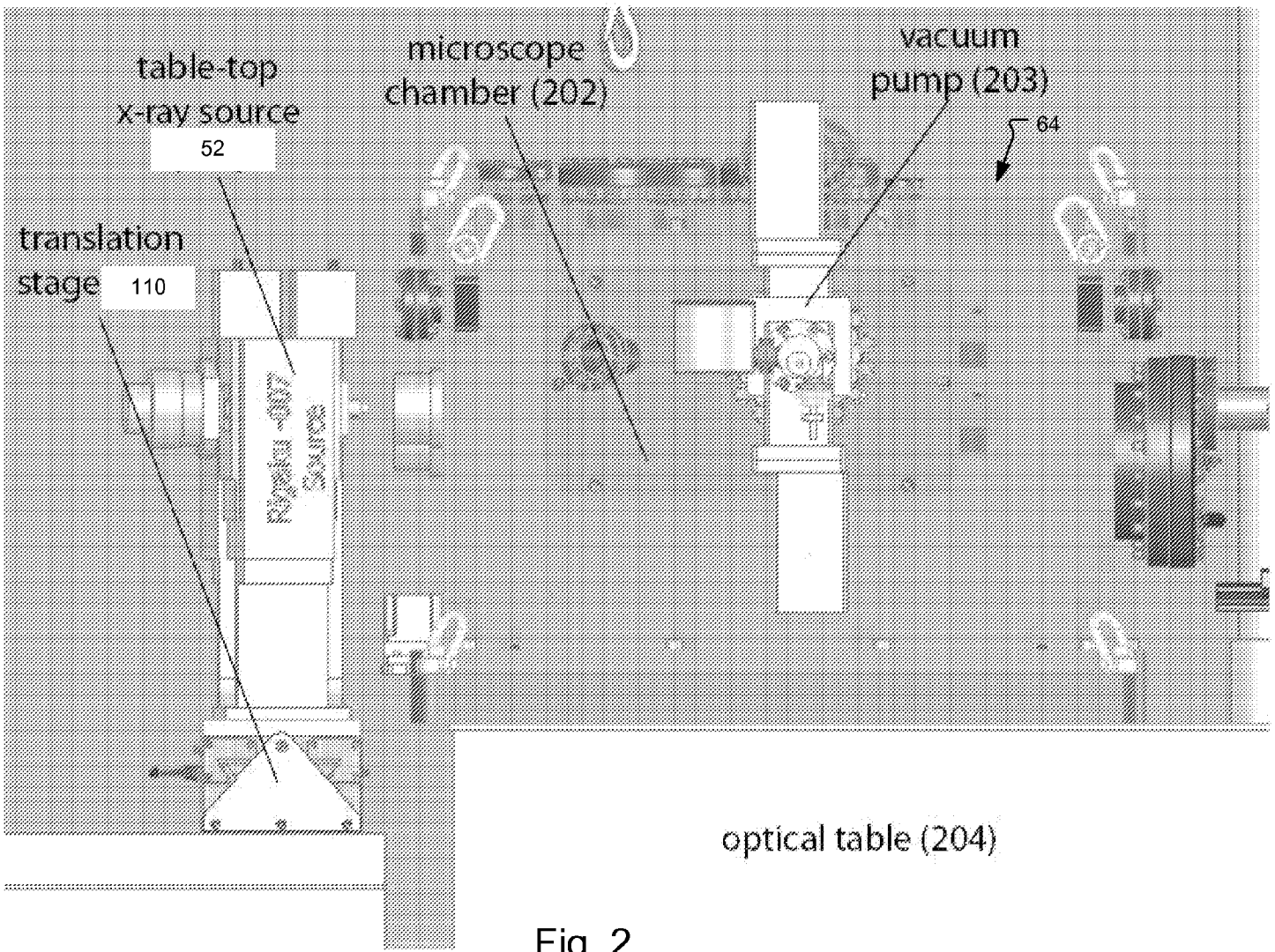
FIG. 2 is an illustration of a side view of the microscope with the mechanical stage system used to performing the source switching action.

FIG. 2 shows the imaging system 64 installed in the optical table 204. The system 64 includes its chamber 202 and vacuum pump 203. In some systems with a vacuum connection, the conditioning optics 60 for the synchrotron beam will also contain provisions for the optics and possibly the microscope to operate in vacuum.

Figure 3:
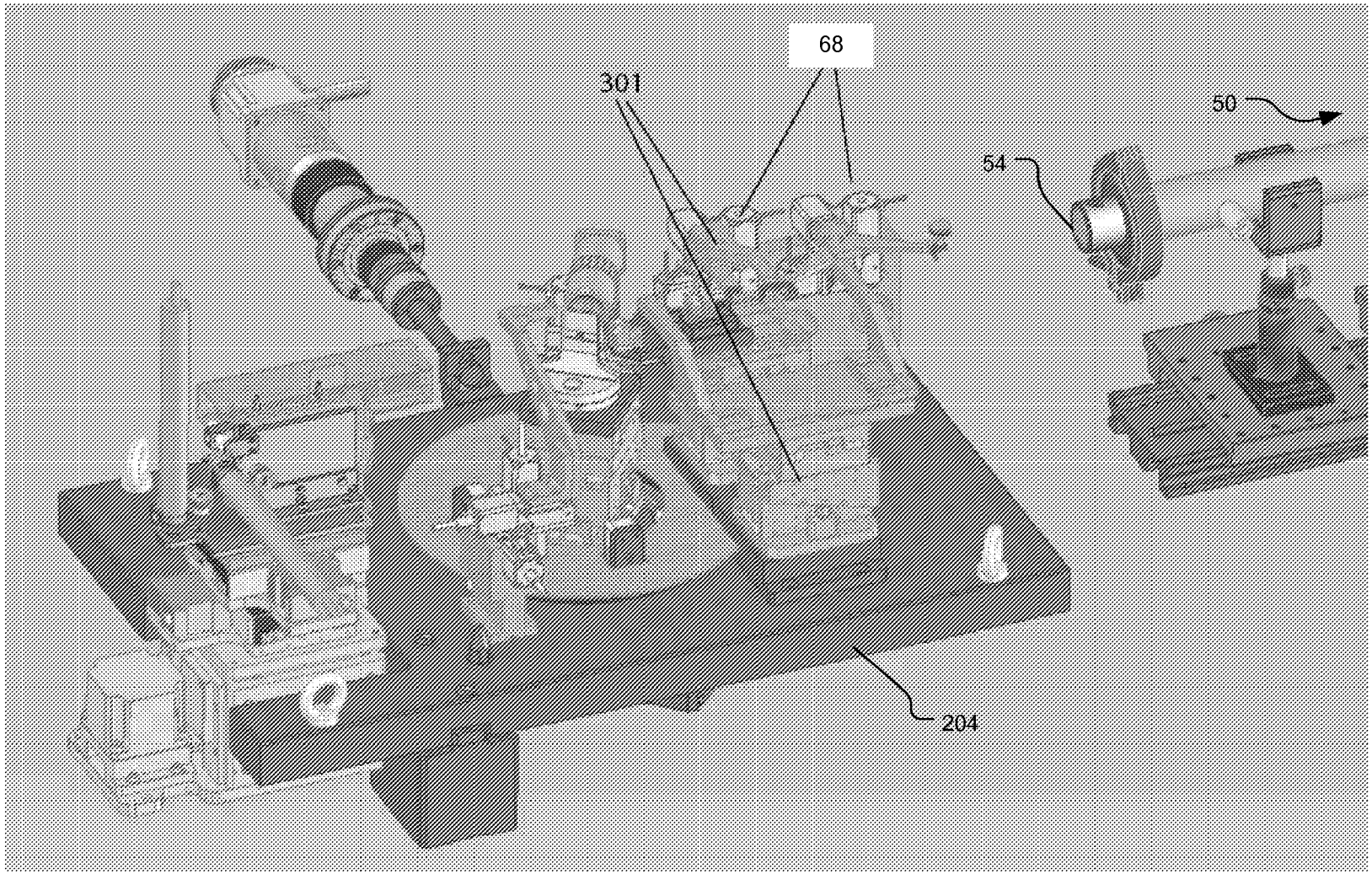
FIG. 3 is an illustration of the microscope without its enclosure to reveal the internal structures.

In this implementation shown in FIGS. 2 and 3, the switching action is provided by a translation stage 110 that carries the x-ray source 52 and an additional set of stages 301 that switches condenser optics 68 on the optical table 204. When the synchrotron beam is available, the table-top x-ray source 52 is translated out of the beam path by the translation stage 110. This implementation also contains a standard vacuum port to connect to a high vacuum beam line port. In some cases, for example with high energy x-ray radiation, the vacuum connection is not required and an open window will be sufficient. However, when using low-energy x-ray radiation, air will absorb a substantial portion of the x-ray beam and a vacuum connection is necessary.

In this configuration, the mechanical stages 301 that carry the condenser lens 68 for table-top x-ray source 52 is also translated out of the beam path and the conditioning optics 60 for the synchrotron beam is translated into the beam path. The monochromator 58 for the synchrotron beam is placed further upstream and remains fixed.

When table-top x-ray source 52 is needed, the synchrotron 50 is disabled by a front-end shutter placed further upstream and the vacuum connection to the beam line is removed. The translation stage 110 is then used to move the x-ray source 52 into the beam path. In this implementation, the position of x-ray source 52 is recorded by an optical encoder during the alignment process and recorded as the future reference position.

After the table-top x-ray source 52 is in position, the conditioning optics 60 for the synchrotron beam is moved out of the microscope's optical axis and the condenser lens 68 for the table-top source 52 is positioned into the beam axis. In this implementation, the condenser lens 68 for the table-top source 58 is an ellipsoidal shaped capillary lens designed with the x-ray source spot and sample position at the foci. An optical encoder tracks the 3-axis position and the yaw and pitch settings of the condenser lens 68 and is set to a reference value during the initial alignment procedure.

Along with the x-ray source, energy filters 66 are also carried by the translation stage 110 and placed at the correct position in the beam path 62. In this implementation, it includes a series of absorptive filters that absorbs the spectra below and above the characteristic emission energy. The filter is mounted directly on the table-top x-ray source.

The implementation described here is designed for a full-field imaging microscope, but will also function with scanning-type imaging systems. Furthermore, other x-ray instruments based at synchrotron radiation sources, such as protein crystallography and computed tomography (CT) can also incorporate this source-switching system to improve the instruments productivity making them functional during the facility's down time.

While this invention has been particularly shown and described with references to preferred embodiments thereof, it will be understood by those skilled in the art that various changes in form and details may be made therein without departing from the scope of the invention encompassed by the appended claims.

What is claimed is:

1. An x-ray system, comprising:

a synchrotron for generating a synchrotron radiation beam;

an integrated x-ray source for generating a source radiation beam;

an imaging system including a sample stage controlled by linear translation stages, an objective x-ray lens, and an x-ray sensitive detector system, placed on a fixed optical table; and a mechanical translation system to switch the imaging system between the source radiation beam of the integrated x-ray source and synchrotron radiation beam of the synchrotron.

2. An x-ray imaging system as claimed in claim 1, wherein a rotation stage is included with the linear translation stages to rotate a sample within the range of 360 degrees.

3. An x-ray imaging system as claimed in claim 1, wherein the mechanical translation system moves the integrated x-ray source along with an energy filter to modify an emission x-ray spectrum.

4. An x-ray imaging system as claimed in claim 1, wherein the mechanical translation system moves an optical element that is able to modify a coherence of the synchrotron radiation beam.

5. An x-ray imaging system as claimed in claim 4, wherein the optical element includes diffractive elements including a grating or Fresnel zone plate lens.

6. An x-ray imaging system as claimed in claim 4, wherein the optical element includes reflective elements including an ellipsoidal lens or Wolter mirror.

7. An x-ray imaging system as claimed in claim 4, wherein the optical element includes compound refractive lenses.

8. An x-ray imaging system as claimed in claim 4, wherein the optical element includes rotating mirror assemblies rotating about the beam axis.

9. An x-ray imaging system as claimed in claim 1, wherein the imaging system is a full-field imaging x-ray microscope.

10. An x-ray imaging system as in claim 1, where the imaging system is a scanning x-ray microscope.

11. An x-ray imaging system as claimed in claim 1, wherein the mechanical translation system moves the integrated x-ray source along with an energy filter to modify an emission x-ray spectrum of the source radiation beam and the energy filter is a grating-based wavelength selection system.

12. An x-ray imaging system as claimed in claim 1, wherein the mechanical translation system moves the integrated x-ray source along with an energy filter system to modify an emission x-ray spectrum of the source radiation beam and the energy filter system includes one or more absorptive energy filters.

* * * * *